US009969937B2

(12) United States Patent
Faegh

(10) Patent No.: US 9,969,937 B2
(45) Date of Patent: May 15, 2018

(54) COKE DRUM ADDITIVE INJECTION

(71) Applicant: Lummus Technology Inc., Bloomfield, NJ (US)

(72) Inventor: Ahmad Faegh, Houston, TX (US)

(73) Assignee: Lummus Technology Inc., Bloomfield, NJ (US)

( * ) Notice: Subject to any disclaimer, the term of this patent is extended or adjusted under 35 U.S.C. 154(b) by 849 days.

(21) Appl. No.: 14/030,219

(22) Filed: Sep. 18, 2013

(65) Prior Publication Data

US 2014/0082999 A1 Mar. 27, 2014

Related U.S. Application Data

(60) Provisional application No. 61/704,020, filed on Sep. 21, 2012.

(51) Int. Cl.

| | |
|---|---|
| ***C10B 55/00*** | (2006.01) |
| ***C10B 55/02*** | (2006.01) |
| ***C10B 57/06*** | (2006.01) |
| ***C10B 1/04*** | (2006.01) |
| ***C10G 9/00*** | (2006.01) |
| ***C10G 11/18*** | (2006.01) |

(52) U.S. Cl.

CPC ..... *C10B 55/02* (2013.01); *C10B 1/04* (2013.01); *C10B 55/00* (2013.01); *C10B 57/06* (2013.01); *C10G 9/005* (2013.01); *C10G 11/18* (2013.01)

(58) Field of Classification Search

None

See application file for complete search history.

(56) References Cited

U.S. PATENT DOCUMENTS

| | | | | |
|---|---|---|---|---|
| 1,831,719 | A | 11/1931 | Pelzer | |
| 3,619,413 | A * | 11/1971 | Folkins | C10B 57/06 208/125 |
| 4,325,810 | A | 4/1982 | Alford et al. | |
| 4,358,366 | A | 11/1982 | Alford et al. | |
| 4,394,250 | A | 7/1983 | Grossberg | |
| 4,466,883 | A | 8/1984 | Eickemeyer et al. | |
| 6,003,789 | A * | 12/1999 | Base | B01F 3/04049 239/398 |
| 2006/0032788 | A1 | 2/2006 | Etter | |

(Continued)

FOREIGN PATENT DOCUMENTS

| | | | |
|---|---|---|---|
| CN | 1791661 | A | 6/2006 |
| WO | 2008064162 | A2 | 5/2008 |

OTHER PUBLICATIONS

International Search Report and Written Opinion dated Dec. 2, 2013 in corresponding International Application No. PCT/US2013/057902 (13 pages).

(Continued)

*Primary Examiner* — Neil N Turk

(74) *Attorney, Agent, or Firm* — Osha Liang LLP

(57) ABSTRACT

A process for producing coke that may include: heating a coker feedstock to a coking temperature to produce a heated coker feedstock; feeding the heated coker feedstock to a coking drum; feeding a coking additive, such as at least one hydroconversion or hydrocracking catalyst, to the coking drum; and subjecting the heated coker feedstock to thermal cracking in the coking drum to crack a portion of the coker feedstock to produce a cracked vapor product and produce a coke product.

11 Claims, 2 Drawing Sheets

(56) References Cited

U.S. PATENT DOCUMENTS

| | | | | |
|---|---|---|---|---|
| 2009/0214394 | A1* | 8/2009 | Lah | B01D 17/00 422/129 |
| 2010/0170827 | A1 | 7/2010 | Etter | |
| 2010/0326880 | A1 | 12/2010 | Chakka et al. | |
| 2011/0005968 | A1 | 1/2011 | Chakka et al. | |
| 2011/0044881 | A1 | 2/2011 | Stansberry et al. | |

OTHER PUBLICATIONS

Office Action dated Mar. 21, 2016 in corresponding Canadian application No. 2,885,717 (4 pages).
Extended European Search Report dated Mar. 29, 2016 in corresponding European application No. 13839419.2 (7 pages).
First Office Action dated Nov. 16, 2015 in corresponding Chinese application No. 201380053231.2 (w/ translation) (17 pages).
Wu Haiyun et al. "Progress in research of improving liquid yield of delayed coking unit by additives"; Petrochemical Technology & Application, vol. 28 No. 4., pp. 338-340—Jul. 31, 2010.
Official Action dated May 30, 2016 in corresponding Russian application No. 2015114803/04(023134) (w/translation) (12 pages).
Second Office Action dated Jun. 14, 2016 in corresponding Chinese applicaton No. 201380053231.2 (w/translation) (14 pages).
Office Action issued in corresponding European Application No. 13389419.2 dated Sep. 8, 2017 (6 pages).
Office Action dated Jun. 30, 2017 in corresponding Canadian application No. 2,885,717 (4 pages).

* cited by examiner

COKE DRUM ADDITIVE INJECTION

CROSS-REFERENCE TO RELATED APPLICATIONS

This application, pursuant to 35 U.S.C. § 119(e), claims priority to U.S. Provisional Application Ser. No. 61/704,020, filed Sep. 21, 2012, which is herein incorporated by reference in its entirety.

FIELD OF THE DISCLOSURE

Embodiments disclosed herein relate generally to the field of petroleum coking processes and apparatus. More specifically, embodiments disclosed herein relate to the production of coke and methods and apparatus for injection of additives into a coke drum to enhance the coking process.

BACKGROUND

The delayed coking process has evolved with many improvements since the mid-1930s. Essentially, delayed coking is a semi-continuous process in which the heavy feedstock is heated to a high temperature (between 900° F. and 1000° F.) and transferred to large coking drums. Sufficient residence time is provided in the coking drums to allow the thermal cracking and coking reactions to proceed to completion. The heavy residua feed is thermally cracked in the drum to produce lighter hydrocarbons and solid, petroleum coke.

The product mixture resulting from the coking process may be affected by the cracking temperature, including heater outlet conditions and coke drum conditions. One of the initial patents for this technology (U.S. Pat. No. 1,831,719) discloses "The hot vapor mixture from the vapor phase cracking operation is, with advantage, introduced into the coking receptacle before its temperature falls below 950° F., or better 1050° F., and usually it is, with advantage, introduced into the coking receptacle at the maximum possible temperature." The "maximum possible temperature" in the coke drum favors the cracking of the heavy residua, but is limited by the initiation of coking in the heater and downstream feed lines, as well as excessive cracking of hydrocarbon vapors to gases (butane and lighter). When other operational variables are held constant, the "maximum possible temperature" normally minimizes the volatile material remaining in the petroleum coke by-product. In delayed coking, the lower limit of volatile material in the petroleum coke is usually determined by the coke hardness. That is, petroleum coke with <8 wt. % volatile materials is normally so hard that the drilling time in the decoking cycle is extended beyond reason. Various petroleum coke uses have specifications that require the volatile content of the petroleum coke by-product be <12%. Consequently, the volatile material in the petroleum coke by-product typically has a target range of 8-12 wt. %.

SUMMARY OF THE DISCLOSURE

The coking process may be enhanced by the addition of various additives to the coking drum. For example, in some embodiments, additives may be used to impact the properties of the coke (hardness, volatile content, combustion properties, coke structure, etc.). In other embodiments, for example, additives may be used to enhance the yield of coke, the yield of cracked hydrocarbon products, or both.

In one aspect, embodiments disclosed herein relate to a process for producing coke. The process may include: heating a coker feedstock to a coking temperature to produce a heated coker feedstock; feeding the heated coker feedstock to a coking drum; feeding a coking additive, such as at least one hydroconversion or hydrocracking catalyst, to the coking drum; and subjecting the heated coker feedstock to thermal cracking in the coking drum to crack a portion of the coker feedstock to produce a cracked vapor product and produce a coke product.

In another aspect, embodiments disclosed herein relate to a system for producing coke. The system may include: a heater for heating a coker feedstock to a coking temperature to produce a heated coker feedstock; a coking drum for thermal cracking the heated coker feedstock to produce a cracked vapor product and a coke product; and a coking additive feed nozzle for directly or indirectly introducing a coking additive comprising at least one hydroconversion or hydrocracking catalyst to the coking drum.

Other aspects and advantages will be apparent from the following description and the appended claims.

DETAILED DESCRIPTION

In one aspect, embodiments disclosed herein relate generally to the field of petroleum coking processes and apparatus. More specifically, embodiments disclosed herein relate to the production of coke and methods and apparatus for injection of coking additives into a coke drum to enhance the coking process. The coking process may be enhanced by the addition of various additives to the coking drum. For example, in some embodiments, additives may be used to impact the properties of the coke (hardness, volatile content, combustion properties, coke structure, etc.). In other embodiments, for example, additives may be used to enhance the yield of coke, the yield of cracked hydrocarbon products, or both. Yield of cracked hydrocarbon products may be increased, for example, by addition of a fluid catalytic cracking catalyst to the coke drum.

Figure 1:
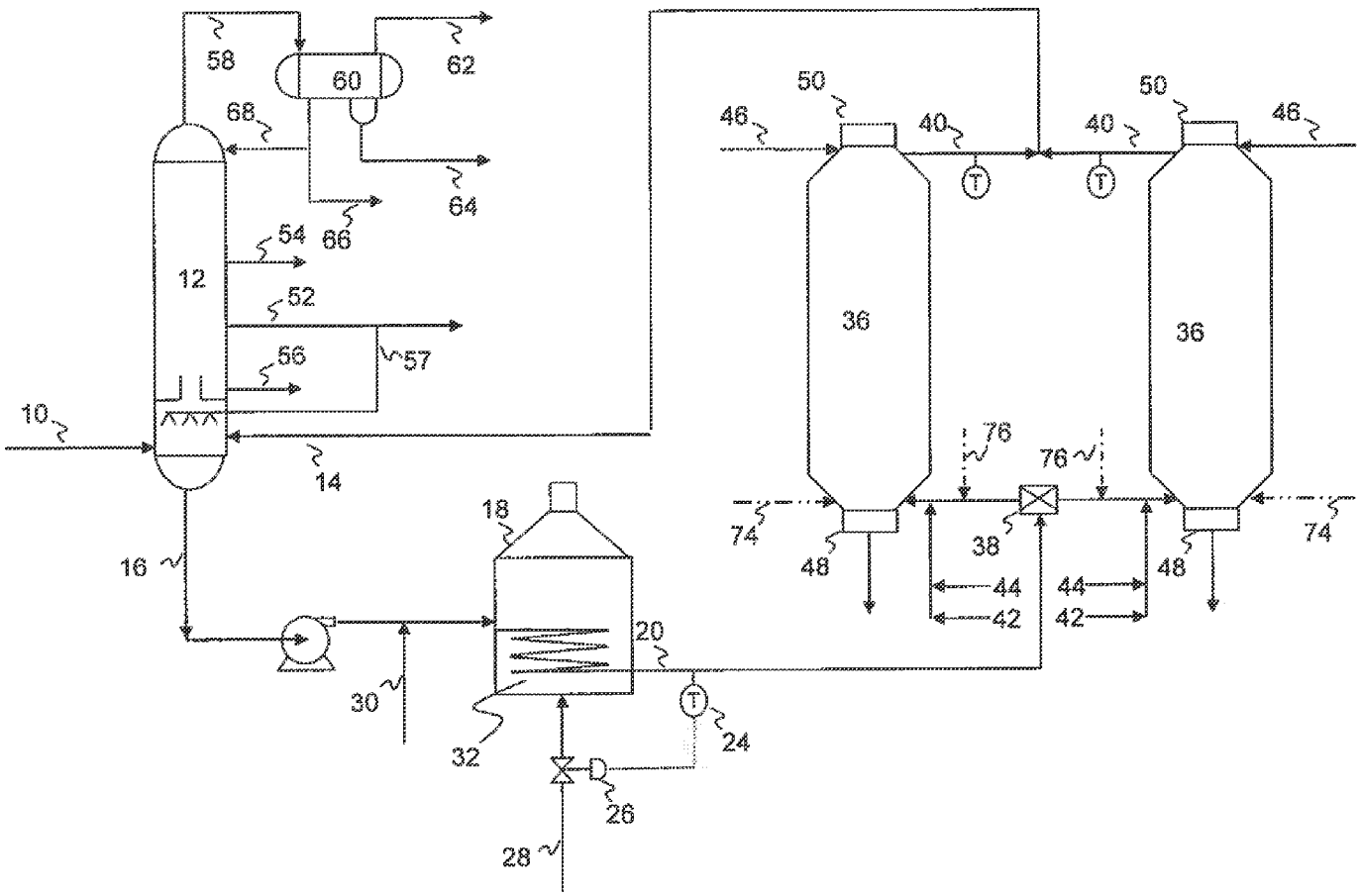
FIGS. 1-3 are simplified diagrams of a coking process and apparatus according to embodiments disclosed herein.

Referring now to FIG. 1, a coking process according to embodiments disclosed herein is illustrated. A coker feedstock 10 is introduced into the bottom portion of a coker fractionator 12, where it combines with hydrocarbons condensed from coke drum overhead vapor stream 14. The resulting mixture 16 is then pumped through a coker heater 18, where it is heated to the desired coking temperature, such as between 750° F. and 1250° F., causing partial vaporization and mild cracking of the coker feedstock. The temperature of the heated coker feedstock 20 may be measured and controlled by use of a temperature sensor 24 that sends a signal to a control valve 26 to regulate the amount of fuel 28 fired in the heater 18. If desired, steam or water condensate/boiler feedwater 30 may be injected into the heater to reduce coke formation in the tubes 32.

The heated coker feedstock 20 may be recovered from the coker heater 18 as a vapor-liquid mixture for feed to coking drums 36. Two or more drums 36 may be used in parallel, as known in the art, to provide for continued operation during the operating cycle (coke production, coke recovery (decoking), preparation for next coke production cycle, repeat). A control valve 38, such as a four-way control valve, diverts the heated feed to the desired coking drum 36.

Sufficient residence time is provided in the coking drum 36 to allow the thermal cracking and coking reactions to proceed to completion. In this manner, the vapor-liquid mixture is thermally cracked in the coking drum 36 to produce lighter hydrocarbons, which vaporize and exit the coke drum via flow line 40. Petroleum coke and some residuals (e.g. cracked hydrocarbons) remain in the coking drum 36. When the coking drum 36 is sufficiently full of coke, the coking cycle ends. The heated coker feedstock 20 is then switched from a first coking drum 36 to a parallel coking drum to initiate its coking cycle. Meanwhile, the decoking cycle begins in the first coking drum.

In the decoking cycle, the contents of the coking drum 36 are cooled down, remaining volatile hydrocarbons are removed, the coke is drilled or otherwise removed from the coking drum, and the coking drum 36 is prepared for the next coking cycle. Cooling the coke normally occurs in three distinct stages. In the first stage, the coke is cooled and stripped by steam or other stripping media 42 to economically maximize the removal of recoverable hydrocarbons entrained or otherwise remaining in the coke. In the second stage of cooling, water or other cooling media 44 is injected to reduce the coking drum temperature while avoiding thermal shock to the coking drum. Vaporized water from this cooling media further promotes the removal of additional vaporizable hydrocarbons. In the final cooling stage, the coking drum is quenched by water or other quenching media 46 to rapidly lower the coking drum temperatures to conditions favorable for safe coke removal. After the quenching is complete, the bottom and top heads or slide valves 48, 50 of the coking drum 36 are removed or opened, respectively. The petroleum coke 36 is then cut, for example, such as by hydraulic water jet, and removed from the coking drum. After coke removal, the coking drum heads or slide valves 48, 50 are closed, respectively, and the coking drum 36 is steam purged free of air, preheated and otherwise readied for the next coking cycle.

The lighter hydrocarbon vapors recovered as an overheads fraction 40 from coking drum 36 are then transferred to the coker fractionator 12 as coker vapor stream 14, where they are separated into two or more hydrocarbon fractions and recovered. For example, a heavy coker gas oil (HCGO) fraction 52 and a light coker gas oil (LCGO) fraction 54 may be drawn off the fractionator at the desired boiling temperature ranges. HCGO may include, for example, hydrocarbons boiling in the range from 650-870° F. LCGO may include, for example, hydrocarbons boiling in the range from 400-650° F. In some embodiments, other hydrocarbon fractions may also be recovered from coker fractionator 12, such as an extra heavy coker gas oil (XHGCO) fraction 56, which may include hydrocarbons heavier than HCGO, and/or a wash oil fraction 57. The fractionator overhead stream, coker wet gas fraction 58, goes to a separator 60, where it is separated into a dry gas fraction 62, a water/aqueous fraction 64, and a naphtha fraction 66. A portion of naphtha fraction 66 may be returned to the fractionator as a reflux 68.

As noted above, the addition of various additives to the coking drum may be used to improve process performance. For example, coking additives may be used to impact the properties of the coke (hardness, volatile content, combustion properties, crystalline (or non-crystalline) structure, etc.), and/or to enhance the yield of coke, the yield of cracked hydrocarbon products, or both.

In conjunction with the coking additive, the temperature of the materials within the coking drum 36 throughout the coke formation stage may be used to control the type of coke crystalline structure and the amount of volatile combustible material in the coke. The temperature of the vapors leaving the coke drum via flow line 40 may thus be an important control parameter used to represent the temperature of the materials within the coking drum 36 during the coking process. For example, conditions may be controlled in a manner to produce sponge coke, shot coke, needle coke, or other varieties of coke having a volatile combustible material (VCM) content in the range from about 5% to about 50% by weight, as measured by ASTM D3175t.

In some embodiments, the coking additive(s) may be added directly to the coking drum 36. For example, the coking additive may be dispersed into an upper portion of the coking drum 36, such as through a feed port, an injection nozzle, a distributor, or other means known to those skilled in the art. In this manner, the additive may mix with the vapors entering coking drum 36, settle with condensing components, whereby the interaction of the additives with the coker feed provides the desired effect. As another example, the coking additive may be dispersed into a lower portion of the coking drum 36, such as via flow line 74.

In other embodiments, the coking additive(s) may be mixed with the coker feed prior to feed of the heated coker feed to the coking drum 36. For example, the coking additives may be mixed with the feed upstream of heater 18 or intermediate heater 18 and coking drum 36. As illustrated, the coking additive may be fed via flow line 76 and mixed with the heated coker feed in the flow conduit 20 immediately upstream of the coking drum 36 proximate the bottom head 48 of the coking drum 36, such as illustrated in greater detail in FIGS. 2 and 3, where like numerals represent like parts.

Feed of a fluid catalytic cracking catalyst to a lower portion of the coking drum 36, such as via either flow line 74 or flow line 76 may provide advantages over feed of the catalyst to an upper portion of the drum, although either may be used according to embodiments herein. For example, feed of the catalyst to a top of the drum, while having a beneficial effect, introduces the catalyst at the reaction tail, where a higher concentration of lighter hydrocarbons exist, and proximate where the vapors and lighter hydrocarbons are exiting the coking drum and may entrain portions of the injected catalyst and prevent all of the catalyst from reaching the reaction front. Feed of the catalyst to a bottom portion of the drum or with the feed may increase the contact time of the catalyst and the hydrocarbons, ensures contact of the catalyst with the heavier hydrocarbon components fed to the coking drum, and may result in increased production of light hydrocarbons as compared to feed of the catalyst to a top of the coking drum.

Figure 3:
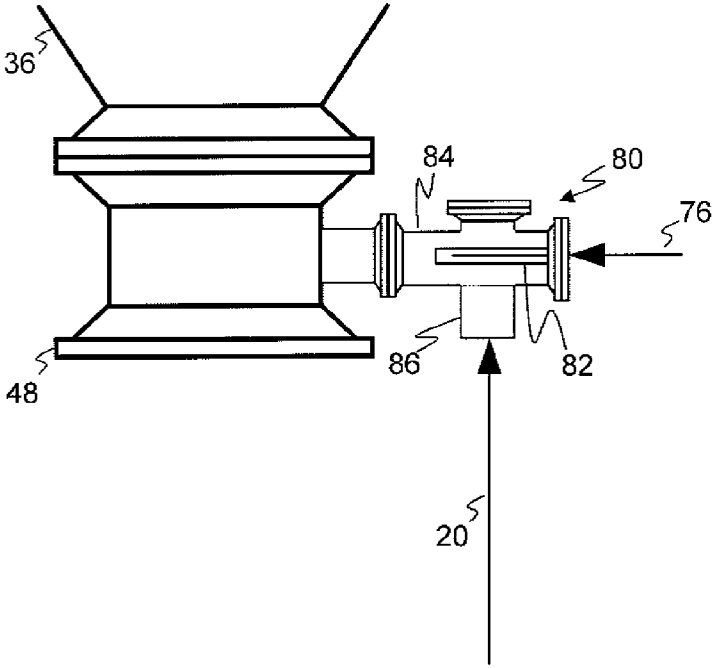
Figure 2:
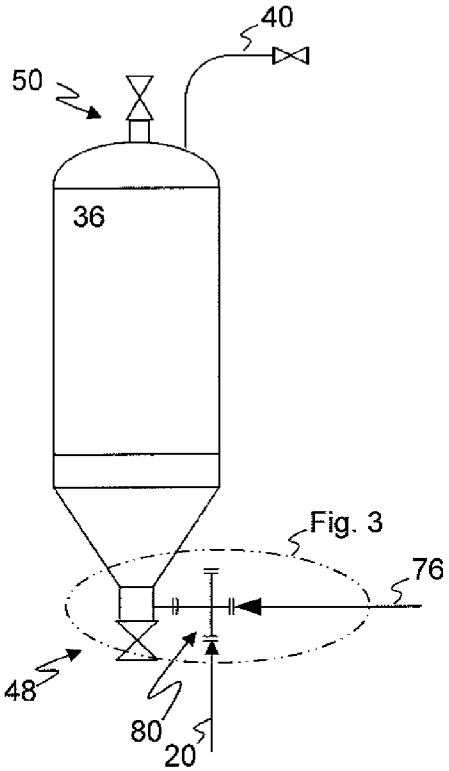

As illustrated in FIGS. 2 and 3, a mixing tee 80 may be used to intimately combine the heated coker feed 20 with the coking additive 76, and the mixture fed to a lower portion of the coking drum 36. The mixing tee 80 may include, for example, two intersecting flow conduits 84, 86. An injection nozzle 82 may extend a defined length up to, into, or through the intersection, providing for injection of the coking additive into the flow of the heated coker feed passing annularly over the injection nozzle 82 and into coking drum 36.

In other embodiments, coking additives may be fed to the coking drum 36 both directly, such as via flow line 74, and indirectly, such as via flow line 76.

The coking additive may be in the form of a gas, a liquid, a solid, a slurry, or a mixture thereof. As such, the feed port, injection nozzle, or dispersing system used to add the coking additive directly or indirectly to the coking drum may be configured to disperse coking additive as at least one of a gas, a liquid, a solid, a slurry, or a combination of these. For example, as illustrated in FIG. 3, the coking additive may be dispersed into the heated coker feed through an injection nozzle 82.

Depending upon the amount of coking additive needed, as well as the type of coking additive, the coking additive may be mixed with a carrier medium for delivery to the coking drum or additive feed location. For example, when the coking additive is to be fed as a slurry, the coking additive may be mixed with a carrier medium, such as a hydrocarbon or water. If the coking additive is gaseous, steam or a light hydrocarbon may also be used as a carrier medium. The carrier medium may thus provide an efficient means for transporting the coking additive, and in some embodiments, result in a measurable and controllable feed rate of the additive mixture. In some embodiments, the carrier medium may include a hydrocarbon or a mixture of hydrocarbons, such as a mixture including one or more hydrocarbons having a boiling point in the range from about 500° F. to about 950° F. The carrier medium may include, for example, one or more of the following: crude oil, atmospheric column bottoms, vacuum tower bottoms, slurry oil, and a liquid product stream from crude or vacuum units, among other suitable refinery streams. In some embodiments, the carrier medium may include hydrocarbons provided by one of streams 10, 14, 52, 54, 56, 57, and 66, among others.

Use of a solid coking additive may result in erosion of the injection nozzle 82 and mixing tee 80, requiring periodic replacement of the additive feed system. Coke build up and routine operations may also require cleaning or isolation of the additive feed system. Accordingly, valves, steam lines, drain lines, and other items not illustrated may be used in conjunction with mixing tee feed lines 74, 76, mixing tee 80, and injection nozzle 82, as appropriate to the feed system, to provide for isolation and cleaning. While described with respect to an additive feed proximate a lower end of coking drum 36, similar concerns may be addressed where the coking additive is fed to an upper portion of coking drum 36, such as via flow line 74.

Coker feedstocks may include any number of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coker feedstocks include atmospheric distillation residuum, vacuum distillation residuum, catalytic cracker residual oils, hydrocracker residual oils, and residual oils from other refinery units.

As known in the art, the coker feedstock may be treated upstream of the coker fractionator 12. For example, the coker feedstock may undergo a hydrotreating process, a desalting process, a demetallization process, a desulfurization process, or other pretreatment processes useful to produce a desirable coker products. Such pretreatment processes are distinct from the embodiments disclosed herein relating to the production of coke and methods and apparatus for injection of coking additives into a coke drum to enhance the coking process.

Coking additives useful in embodiments herein may include one or more catalysts useful for the cracking of hydrocarbons. Suitable hydrotreating and hydrocracking catalysts useful as an additive to the coking drum may include one or more elements selected from Groups 4-12 of the Periodic Table of the Elements. In some embodiments, the hydrotreating and hydrocracking catalysts according to embodiments disclosed herein may comprise, consist of, or consist essentially of one or more of nickel, cobalt, tungsten, molybdenum and combinations thereof, either unsupported or supported on a porous substrate such as silica, alumina, titania, or combinations thereof. As supplied from a manufacturer or as resulting from a regeneration process, the hydrotreating and hydrocracking catalysts may be in the form of metal oxides, for example. If necessary or desired, the metal oxides may be converted to metal sulfides prior to or during use. In some embodiments, the hydrotreating and hydrocracking catalysts may be pre-sulfided and/or preconditioned prior to introduction to the coking drum.

Various chemical and/or biological agents may also be added to the coking process to inhibit the formation of shot coke and/or promote the formation of desirable sponge coke. In particular embodiments, an anti-foaming agent may be added, such as a silicon-based additive. The chemical and/or biological agents may be added at any point in the process, and in some embodiments are added along with the coking additive.

One of skill in the art will understand and appreciate that the specific selection of a coking additive according to the embodiments herein will depend upon several factors including: the feed composition; the dosage rate of and concentration of the additive within the feed; the feed rate; the temperature, pressure and other conditions of operation of the unit; the desired properties of the overhead fraction resulting from the process; the desired properties of the coke derived from the process; and similar such variables known to one of skill in the art. Thus a routine optimization process will need to be carried out to achieve the desired results for any given feed and such an optimization process is not considered to be outside of the scope of such a skilled person nor outside of the scope of the present disclosure.

The addition of a coking additive according to embodiments herein may only be desirable for a portion of the coking cycle. For example, it may be desirable to delay addition of the coking additives for a selected period of time after initiation of coke formation within a coking drum 36. For example, having coke in the coking drum may provide surface area on which the coking additive may disperse and interact with the hydrocarbon feed, resulting in the desired effect, such as heightened production of volatile hydrocarbons, for example.

As described above, embodiments described herein advantageously provide for addition of coking additives to a coking drum. The addition of these coking additives may be used, for example, to advantageously impact the properties of the coke (hardness, volatile content, combustion properties, crystalline (or non-crystalline) structure, etc.), and/or to enhance the yield of coke, the yield of cracked hydrocarbon products, or both.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for producing coke, the process comprising:

heating a coker feedstock to a coking temperature to produce a heated coker feedstock;

mixing the heated coker feedstock and a coking additive comprising at least one hydroconversion or hydrocracking catalyst via a mixing tee to produce a mixture, wherein the mixing tee comprises at least two intersecting flow conduits and an injection nozzle extending into a perpendicular intersection of the at least two intersecting flow conduits, wherein the mixing comprises passing the heated coker feedstock annularly over the injection nozzle and injecting the coking additive via the injection nozzle into the heated coker feedstock;

feeding the mixture to a bottom head of a coking drum;

subjecting the heated coker feedstock to thermal cracking in the coking drum to crack a portion of the coker feedstock to produce a cracked vapor product and produce a coke product.

2. The process of claim 1, wherein the coke product has a VCM concentration in the range from about 5% to about 50% by weight, as measured by ASTM D3175t.

3. The process of claim 1, wherein the coke product comprises at least one of sponge coke, needle coke, and shot coke.

4. The process of claim 1, wherein mixing the heated coker feedstock comprises feeding the heated coker feedstock to the mixing tee for a selected time period prior to feeding the coking additive to the mixing tee.

5. The process of claim 1, further comprising admixing the coking additive with a carrier medium.

6. The process of claim 5, wherein the carrier medium comprises a hydrocarbon or a mixture of hydrocarbons.

7. The process of claim 6, wherein the carrier medium comprises a mixture including one or more hydrocarbons having a boiling point in the range from about 500° F. to about 950° F.

8. A process for producing coke, the process comprising:

heating a coker feedstock to a coking temperature to produce a heated coker feedstock;

mixing the heated coker feedstock and a coking additive comprising at least one hydroconversion or hydrocracking catalyst via a mixing tee to produce a mixture, wherein the mixing tee comprises at least two intersecting flow conduits and an injection nozzle extending into a perpendicular intersection of the at least two intersecting flow conduits, and wherein the mixing comprises passing the heated coker feedstock annularly over the injection nozzle and injecting the coking additive via the injection nozzle into the heated coker feedstock;

feeding the mixture to a bottom head of a coking drum; and subjecting the heated coker feedstock to cracking in the coking drum to crack a portion of the coker feedstock to produce a cracked vapor product and produce a coke product.

9. The process of claim 8, wherein the coking additive is a solid.

10. The process of claim 8, wherein the coking additive is a slurry.

11. The process of claim 8, wherein the mixing tee is immediately upstream of the coking drum proximate the bottom head of the coking drum.

* * * * *